US005163417A

United States Patent [19]

Dalton

[11] Patent Number: 5,163,417

[45] Date of Patent: Nov. 17, 1992

[54] FIREPLACE SCREEN

[76] Inventor: Paul J. Dalton, 34 Doone St., Thousand Oaks, Calif. 91360

[21] Appl. No.: 780,123

[22] Filed: Oct. 21, 1991

[51] Int. Cl.[5] ..... F24B 1/192

[52] U.S. Cl. ..... 126/544; 160/DIG. 9

[58] Field of Search ..... 126/544, 547, 551, 545, 126/548; 160/DIG. 9

[56] References Cited

U.S. PATENT DOCUMENTS

| | | | |
|---|---|---|---|
| 328,342 | 10/1885 | Robinson | 126/544 X |
| 2,023,604 | 12/1935 | Lovejoy, Jr. | 126/544 X |
| 2,294,046 | 8/1942 | Cser | 160/DIG. 9 |
| 2,743,720 | 5/1956 | Dollinger | 126/546 |
| 4,574,773 | 3/1986 | Moughamian | 126/546 X |

*Primary Examiner*—Larry Jones
*Attorney, Agent, or Firm*—Jack C. Munro

[57] ABSTRACT

A fireplace screen which is formed of a plurality of translucent panels which can be constructed of any one of a variety of colors with each panel being constructed of a multitude of colors. The observing of the burning of wood or other similar material within the fireplace through the panels produces a most attractive explosion of colors resulting in a most attractive appearance.

6 Claims, 1 Drawing Sheet

FIG. 1
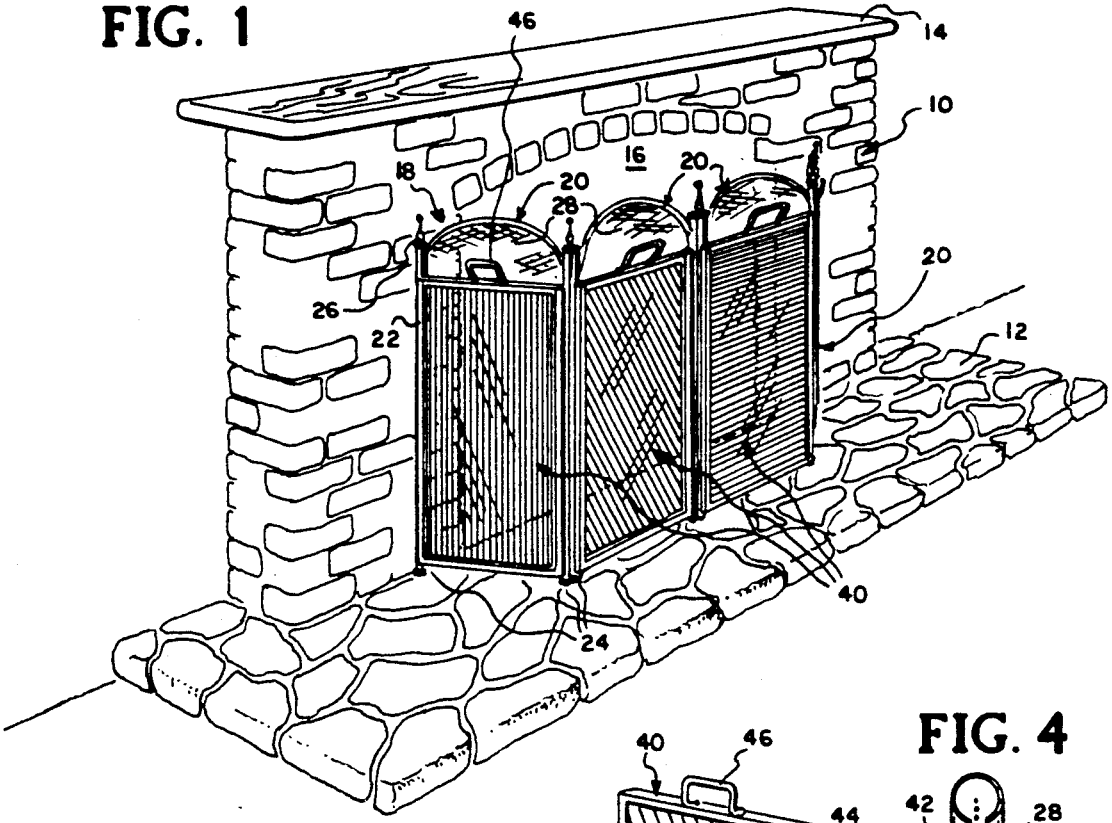
FIG. 2
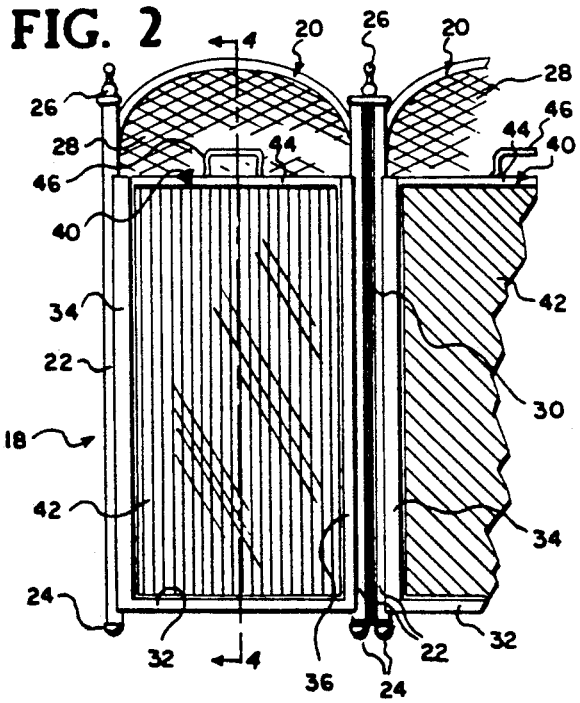
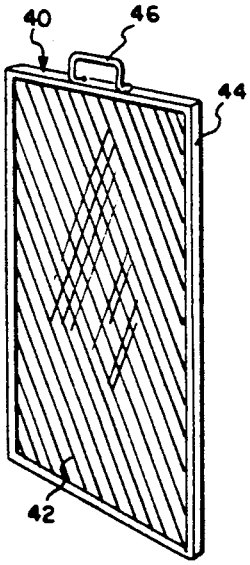
FIG. 3
FIG. 4
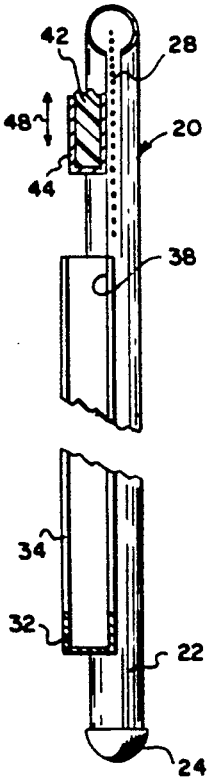
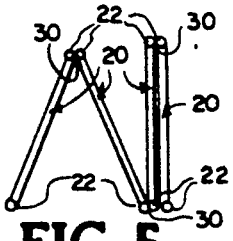
FIG. 5

FIREPLACE SCREEN

BACKGROUND OF THE INVENTION

1) Field of the Invention

The field of this invention relates to a fireplace screen and more particularly to a fireplace screen which produces an attractive appearance during the combusting of material within the fireplace.

2) Description of Prior Art

The use of screens in conjunction with fireplaces has long been known. The primary purpose of such a screen is to prevent the escape of sparks and burning chips of material from the fireplace when the fireplace is utilized. When the fireplace is not utilized, the screen is generally constructed to be attractive in appearance so that in itself it is an attractive addition to any room's decor.

SUMMARY OF THE INVENTION

The primary objective of the present invention is to construct a fireplace screen which utilizes the light that is produced due to the combustion within the fireplace to produce an ever changing colorful appearance as the fireplace is being utilized.

Prior to the construction of the present invention, there has not been known to utilize the combustion within the fireplace in conjunction with the fireplace screen to produce a most desireable ornamental appearance.

The further object of the present invention is to construct a fireplace screen which is non complex, can be manufactured at reasonable price and therefore sold to the ultimate consumer at a reasonable price.

Another objective of the present invention is to construct a fireplace screen which is composed of a multitude of colorful panels which are sufficiently heat resistant to be protective against the heat emitted from the fireplace as well as any sparks or small burning chips that may be emitted during the combusting of material within the fireplace.

The fireplace screen of the present invention is composed of a plurality of leaves. These leaves are generally rectangular in configuration and are all of about the same size. The fireplace screen can be located in a stretched out configuration where the leaves are located substantially in alignment to each other or the leaves can be located in a side by side abutting relationship resulting in the fireplace screen assuming a folded configuration. The folded configuration is what is commonly used in conjunction with storage of the fireplace screen and/or shipping. Each leave includes a channel arrangement. To be slidingly engaged with each channel is a panel. These panels are constructed primarily of a colorful translucent material with any desireable color being employed or any desireable arrangement of colors being employed within the single panel. These panels will normally be constructed of plastic or glass material.

BRIEF DESCRIPTION OF THE DRAWING

FIG. 1 is a perspective view showing a typical fireplace where the fireplace screen of the present invention is shown mounted in conjunction therewith;

FIG. 2 is an enlarged rear view of a portion of the fireplace screen of the present invention showing in more detail the construction of the fireplace screen;

FIG. 3 is an isometric view of a panel that is to be removably engaged with the leaves of the fireplace screen with this panel including a colorful translucent sheet;

FIG. 4 is a cross sectional view through the fireplace screen of the present invention taken along line 4—4 of FIG. 2 showing the panel either about to be inserted in conjunction with the leave or in the process of being removed from the leave; and FIG. 5 is a perspective view of the screen of this invention showing the screen in the folded configuration.

DETAILED DESCRIPTION OF THE SHOWN EMBODIMENT

Referring particularly to the drawing, there is shown a typical fireplace 10 which has a hearth 12 and a mantle 14. The fireplace 10 includes a firebox 16 within which the wood or other material is to be burned. The fireplace screen 18 of the present invention is shown placed on the hearth 12 in front of the firebox 16. The location of the fireplace screen 18 of this invention is conventional in its employment.

The fireplace screen 18 is composed of four in number of leaves 20. Each leave 20 is constructed substantially identical. Each leave 20 will generally be constructed of metal with usually some type of ornamentation-type metal being preferred such as brass. Each leave 20 is constructed of a pair of tubular side rails 22 located in a parallel spaced apart manner. Each of the side rails 22 are of the same length and of the same size. The bottom of each of the side rails 22 has mounted thereon feet 24 which rests against the hearth 12. The upper end of the side rails 22 has mounted thereon ornamental fixtures 26. The upper portion of each leave 20 includes a metallic screening 28.

Each pair of the leaves 20 that are located directly adjacent to one another, that is their side rails 22 being located in close proximity, are to be connected together by one or more hinges 30. These hinges 30 permit the screen 18 to be folded so that the leaves 20 are in the side-by-side configuration as is clearly shown in FIG. 5 of the drawings.

The outside surface of this screen 18 is what is located furthest from the firebox 16. The portion of the screen 18 that is located nearest the firebox 16 is what is termed the inside surface. At the inside surface of each leave 20 there is mounted a U-shaped channel comprised of a bottom rail 32 and side rails 34 and 36. The side rails 34 and 36 are open at the top such as is shown by access opening 38 for rail 34 in FIG. 4. The length of the rails 34 and 36 are identical. The rails 34 and 36 are located parallel to one another and are perpendicular to the rail 32.

Referring particularly to FIG. 3 there is shown a rectangularly shaped thin panel 40. Each panel 40 is formed of a translucent member 42. Surrounding the edge of the member 42 is a frame 44. Frame 44 will normally be constructed of a metallic material and a material that is the same or compatible with the material of construction for each of the leaves 20. To the top edge of the mounting frame 44 is mounted a handle 46. Each of the panels 40 are able to be manually maneuvered by a user grasping handle 46 so that the mounting frame 44 engages with channel members 32, 34 and 36. Arrow 48 represents the direction of insertion of a panel 40 into and out of the channel members 32, 34 and 36 within FIG. 4 of the drawings. The panel 40 is merely slid into the channel members 32, 34 and 36 or slid out of when it is desired to replace a panel 40.

The reasons that one would want to replace a panel 40 would be to achieve a different visual representation. A desirable visual representation is attained from each panel 40 by the light from the firebox 16 being transmitted through each of the sheet material members 42. Each of the sheet material members 42 is translucent and may possibly even be transparent. Each panel 42 is to be constructed of a particular colored material such as red, blue, green and amber and so forth. It has been found that normally the more striking the color of the panel 42 the more striking the visual respresentation exteriorly of the panel 42. In other words, attractive blues produce a most attractive appearance when observing the combustion within the firebox 16. In a similar manner attractive yellows again produce most attractive appearances. A fireplace screen 18 may utilize the same color members 42 throughout or may use different colored members 42. Also, considered to be within the scope of this invention is that the members 42 may be multicolored and thereby produce a multicolored effect.

If the user desires to achieve a different colored effect, a particular panel 40 can be removed and replaced with a different panel 40 of a different color.

One desirable material for each of the members 42 would be what is known to be Plexiglas which is a trade name for an acrylic plastic. Plexiglas is usually comprised of cast or extremely durable plastic sheets. However the sheets could be extruded or injection molded. Plexiglas is available in a variety of sizes, thickness and pattern and can be produced to be transparent or translucent as well as in a variety of colors. Plexiglas can also be made to be heat resistant up to 200 degrees Fahrenheit or greater. It has been found that 200° F. in conjunction with a fireplace screen is adequate heat resistance.

Another desirable material for each of the members 42 would be glass. The undesirable part about glass is that it is subject to breakage where Plexiglas, of course, would not. A breakage is likely to occur during transporting and shipping of the screen 18. One desirable thing about glass is that it is more heat resistant than plastic and less likely to be damaged by sparks or flaming fragments of the combustible material located within the firebox 16.

A further way that the members 42 can be manufactured would be by using a window film mounted on either plastic or glass. The members 42 could be constructed to be transparent. The window film (not shown) would comprise a plastic colored film. This colored film could be applied either on a permanent basis or on a removeable basis if such is deemed to be desired. Colored window films for glass are in common usage especially in conjunction with decreasing the effect of the sun's rays through a window.

What is claimed is:

1. A fireplace screen comprising:

a housing formed of a plurality of interconnected leaves, said leaves being movable relative to each other permitting said leaves to be folded in a side-by-side abutting relationship, said leaves being also movable to a stretched position where said leaves are located in a substantially aligned position, each said leave having parallel spaced-apart side edges;

mounting means connected to each said side edge of each said leave; and a plurality of panels, a said panel to connect with a said leave covering almost the entire area of its respective said leave, each said panel to removably connect with said mounting means, each said panel being translucent, each said panel being colored so as to transmit light in a specific color arrangement producing a visually desireable appearance caused by observing of the light produced within a fireplace.

2. The fireplace screen as defined in claim 1 wherein:

each said panel being constructed of a sheet material member enclosed by a mounting frame, each said sheet material member being formed of a heat resistant material.

3. The fireplace screen as defined in claim 2 wherein:

said mounting means comprising a plurality of channels, said mounting frame of a said panel connecting with said channels.

4. The fireplace screen as defined in claim 3 wherein:

each said panel including a handle, said handle facilitating manual connection of said mounting frame with said channels and disengagement of said mounting frame from said channels.

5. The fireplace screen as defined in claim 4 wherein:

said leaves being pivotally connected together.

6. The fireplace screen as defined in claim 5 wherein:

each of said leaves being substantially the same size, each of said panels being of the same size.

* * * * *